United States Patent [19]

Michalski

[11] 4,373,274

[45] Feb. 15, 1983

[54] ENCLOSURE ARRANGEMENT FOR WARMED FOOTWEAR

[76] Inventor: William J. Michalski, P.O. Box 18, Bloomingdale, N.J. 07403

[21] Appl. No.: 236,204

[22] Filed: Feb. 20, 1981

[51] Int. Cl.[3] ..... A43B 7/02

[52] U.S. Cl. ..... 36/2.6; 36/136; 126/206

[58] Field of Search ..... 36/2.6, 3 R, 3 A, 136; 126/204, 206

[56] References Cited

U.S. PATENT DOCUMENTS

| | | | |
|---|---|---|---|
| 3,018,570 | 1/1962 | Bliese | 36/136 X |
| 4,023,282 | 5/1977 | Ziegelheaper | 36/2.6 |
| 4,094,080 | 6/1978 | Sanders | 36/2.6 |
| 4,249,319 | 2/1981 | Yoshida | 36/2.6 |
| 4,268,272 | 5/1981 | Taura | 126/206 X |

FOREIGN PATENT DOCUMENTS

| | | | |
|---|---|---|---|
| 338469 | 3/1904 | France | 36/2.6 |

*Primary Examiner*—James Kee Chi

*Attorney, Agent, or Firm*—Samuelson & Jacob

[57] ABSTRACT

An enclosure arrangement for use in connection with a boot whereby a booted foot will be warmed selectively by a warming device placed within a chamber placed above an apertured instep portion of the boot.

22 Claims, 7 Drawing Figures

ENCLOSURE ARRANGEMENT FOR WARMED FOOTWEAR

The present invention relates generally to footwear and pertains, more specifically, to an arrangement whereby a booted foot will be warmed selectively by a warming device placed within a chamber juxtaposed with the instep portion of a boot.

A variety of structural arrangements has been suggested for heated footwear. In some instances, heating devices are placed in various locations within a boot or a shoe to provide warmth. In other arrangements, heating devices are attached temporarily to a boot or a shoe for warming the footwear. In most of the existing arrangements, a booted foot is heated without taking into account fully an increase in moisture within the boot resulting from perspiration. As a result, many of the suggested heating arrangements can become uncomfortable due to excessive moisture within the boot. In addition, selectivity in the application of heat to a booted foot is limited by the structural arrangements in currently available heated footwear.

It is an object of the present invention to provide an enclosure arrangement whereby a booted foot may be warmed without a deleterious build-up of moisture within the boot being worn.

Another object of the invention is to provide an enclosure arrangement which facilitates selective warming of a booted foot without requiring removal of the boot from the foot to commence or to discontinue the warming.

Still another object of the present invention is to provide an arrangement whereby existing boots may be modified by the wearer to incorporate a warming device for warming the wearer's feet.

Yet another object of the invention is to provide an enclosure arrangement which enables the use of commonly available warming devices in connection with boots to warm booted feet.

Another object of the invention is to provide an enclosure arrangement of the type described and which can be supplied in a kit for application to existing boots with relative ease.

Yet another object of the invention is to provide an enclosure arrangement of the type described and which is versatile so as to enable use in connection with a variety of boot and shoe styles.

A further object of the invention is to provide an enclosure arrangement of the type described and which enables effective warming of a wearer's feet while maintaining the integrity of the boot structure insofar as the structure is maintained sealed against water, mud and other unwanted elements which the boot structure itself is designed to combat.

A still further object of the invention is to provide an enclosure arrangement of the type described and which is easy to use for selective warming of a wearer's feet.

Yet a further object of the invention is to provide an enclosure arrangement of the type described and which is economically fabricated in large numbers of uniform high quality.

The above objects, as well as still further objects and advantages, are attained by the present invention which may be described briefly as an enclosure arrangement for use in connection with a boot whereby a booted foot will be warmed selectively by a warming device, the boot having a longitudinally extending sole and an upper extending altitudinally from a welt area at the intersection of the sole and the upper, the sole including a toe end, a heel end and a shank between the toe end and heel end, and the upper including a toe adjacent the toe end, a counter adjacent the heel end, a sheath extending altitudinally between the toe and the counter and an apertured instep portion located between the toe and the sheath, the enclosure arrangement comprising: an enclosure member having a wall, the wall including first edge areas for extending generally longitudinally along the welt area between the toe end of the sole and the shank, and second edge areas for extending generally altitudinally along the upper between the welt area, adjacent the shank, and a location on the sheath spaced altitudinally from the apertured instep portion a distance sufficient to establish a chamber overlying the apertured instep portion between the toe of the upper and the sheath; means for joining the first and second edge areas with the boot so as to secure the enclosure member to the boot and establish a seal along the edges for sealing the chamber; an access opening in the wall of the enclosure member and juxtaposed with the chamber to enable selective access to the chamber for placement therein of the warming device; and closure means for selectively opening and closing the access opening.

The invention will be more fully understood, while still further objects and advantages will be made apparent, in the following detailed description of preferred embodiments of the invention illustrated in the accompanying drawing, in which.

Figure 1:
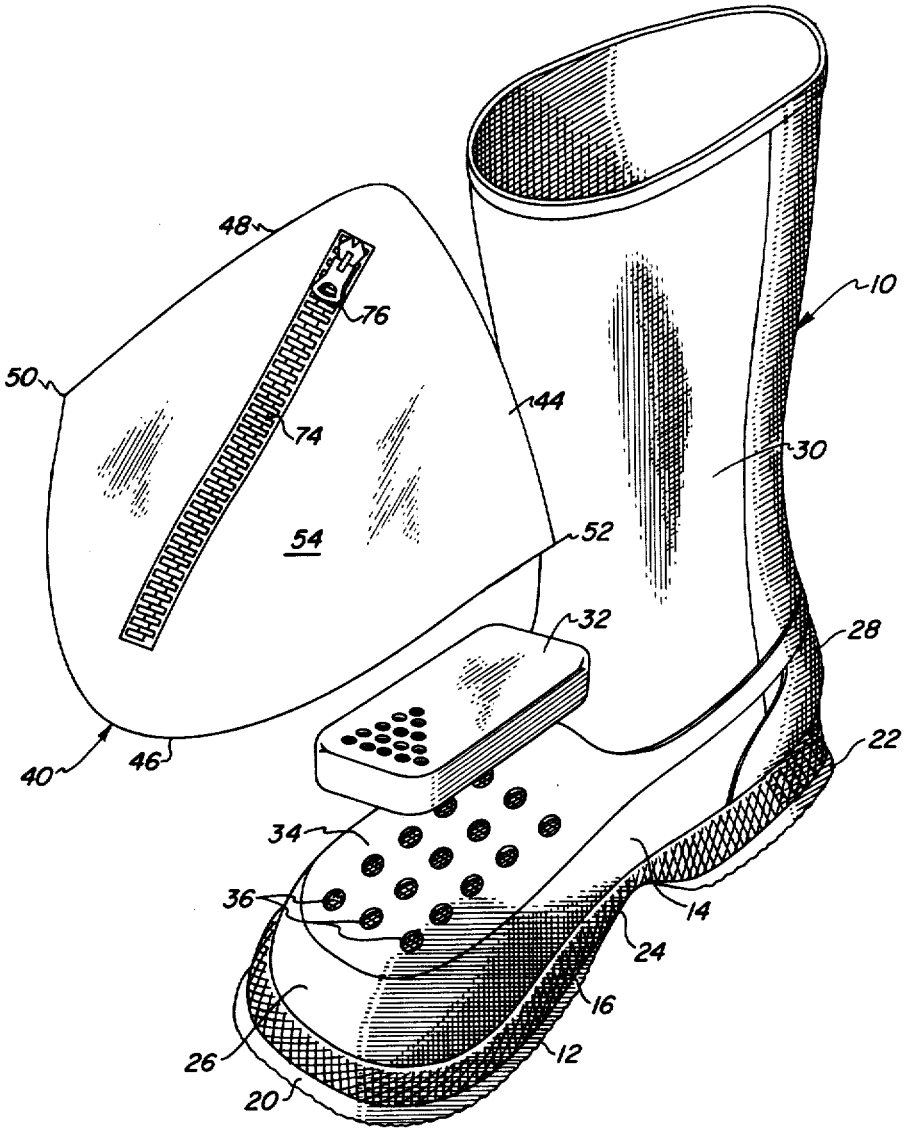
FIG. 1 is an exploded perspective view of an enclosure arrangement constructed in accordance with the invention and illustrating the manner in which the enclosure arrangement is used in connection with a boot.

Referring now to the drawing, and especially to FIG. 1 thereof, footwear is illustrated in the form of a boot 10 which, in this instance, is constructed in the form known as a "slush boot." Boot 10 has a waterproof construction which is an essentially integral molded structure fabricated of a water-resistant material, such as an elastomer, and includes a longitudinally extending sole 12 and an upper 14 extending altitudinally upwardly from a welt area 16 located at the intersection of the sole 12 and the upper 14. Sole 12 includes a toe end 20, a heel end 22 and a shank 24 located between the toe end 20 and heel end 22. Upper 14 has a toe 26 adjacent toe end 20, a counter 28 adjacent heel end 22, and a calf portion or sheath 30 extending altitudinally upwardly between the toe 26 and the counter 28. Thus, boot 10 has a generally conventional construction and represents one of a wide variety of currently available boot styles.

Many boots find use in protecting a wearer's feet against low temperatures, as well as against various adverse and uncomfortable elements, such as water and mud. Boots used in a wide variety of outdoor and indoor work, outdoor sports and recreation often are exposed to low temperatures and adverse elements and conditions. Boot 10 is one such boot and is shown modified for use in connection with the present invention to enable a wearer's booted foot to be warmed with a separate warming device, illustrated at 32. Thus, instep portion 34 of boot 10, which instep portion 34 is located between toe 26 and sheath 30, has been provided with apertures 36, as by punching holes through the instep portion 34. Warming device 32 is to be juxtaposed with the apertured instep portion 34 so that heat from the warming device 32 can be transferred readily to the wearer's foot. The size and relative placement of apertures 36 are chosen so as to preserve the structural integrity of the instep portion 34 of the boot, while still enabling the appropriate heat transfer. Thus, apertures which are too large or too closely spaced would tend to weaken the instep portion 34, rendering the boot too flexible, while apertures which are too small or spaced too distantly would not enable enough heat to be transferred. Various combinations of open areas and reinforcing structures are possible and are encompassed within the term "apertured instep portion".

An enclosure member 40 is to be secured in place over the apertured instep portion 34 in such a way as to establish a chamber 42 (see FIG. 4) overlying the apertured instep portion 34 between the toe 26 and the sheath 30. In this manner, the integrity of boot 10, which has been disturbed by the provision of apertures 36, will be restored largely by the enclosure member 40 which will enclose and seal the apertured instep portion 34 against adverse elements, while enabling selective placement of warming device 32 in juxtaposition with apertured instep portion 34, all as explained in greater detail below.

Figure 2:
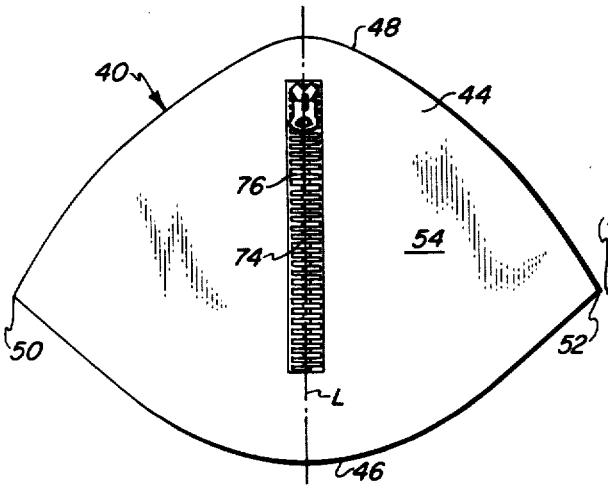
FIG. 2 is a plan view showing the outer surface of the enclosure member of the arrangement.
Figure 3:
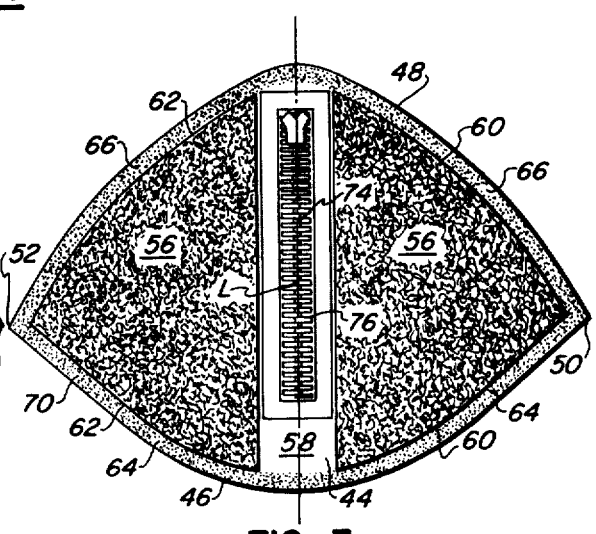
FIG. 3 is a plan view showing the inner surface of the enclosure member.

Turning now to FIGS. 2 and 3, enclosure member 40 has a wall 44 of flexible, water-repellant material, such as a rubberized fabric. The material of wall 44 preferably is chosen so that the wall 44 is somewhat porous and enables some "breathing" to take place; that is, water vapor will pass through the material, while water in its liquid form will not. The plan configuration of wall 44 includes opposite first and second edges 46 and 48, respectively. Edges 46 and 48 are curved and intersect at opposite apices 50 and 52. The outside surface 54 of wall 44 preferably is smooth and water-resistant. Layers 56 of heat insulating material are affixed to the inside surface 58 of wall 44, although advantages of the present construction can be realized even without the added layers 56. The edges 60 and 62 of layers 56 are spaced from corresponding edges 46 and 48 of wall 44 to establish first and second edge areas 64 and 66. Means in the form of an adhesive, as shown at 70, may be applied all along edge areas 64 and 66 to secure the enclosure member 40 to boot 10.

Figure 4:
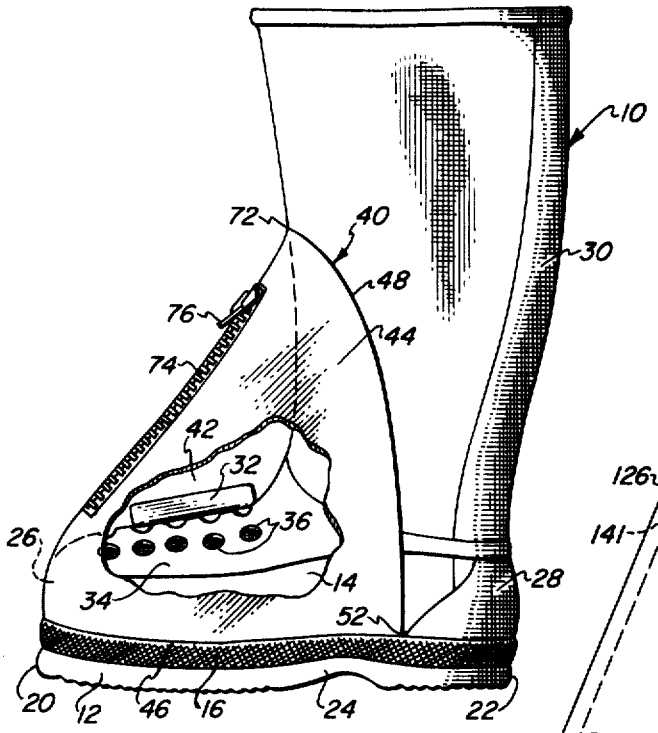
FIG. 4 is a side elevational view of the enclosure arrangement on the boot, with portions cut away to reveal interior details.

When enclosure member 40 is secured to boot 10, as seen in FIG. 4, the first edge 46, and corresponding edge areas 64, extend generally longitudinally along the welt area 16 between toe end 20 of sole 12 and shank 24, while the second edge 48, and corresponding second edge areas 66, extend generally altitudinally along the upper 14 between the welt area 16, adjacent shank 24, and a location 72 spaced altitudinally upwardly from the apertured instep portion 34. The distance between the apertured instep portion 34 and location 72 is great enough to provide chamber 42 with sufficient volume to house warming device 32.

Warming device 32 may be a conventional, currently available warmer such as those sold as hand warmers. These warming devices utilize either solid or liquid fuel and generate sufficient heat for the purposes of the present invention. Warming device 32 is selectively inserted into chamber 42 or removed from chamber 42 at anytime, even when boot 10 is being worn. Boot 10 need not be removed from the wearer's foot to accomplish insertion or removal of warming device 32 by virtue of the provision of an access opening in the form of a slit 74 in wall 44 of the enclosure member 40. Referring to FIGS. 2 and 3 once again, slit 74 is located along a straight line L extending generally transverse to the direction of extent of edges 46 and 48 of wall 44 such that slit 74 provides an access opening between toe 26 and sheath 30 for the insertion and removal of warming device 32. Closure means in the form of a slide fastener 76 enables the access opening provided by slit 74 to be opened or closed, selectively, with ease.

The juxtaposition of chamber 42, and the warming member therein, with the apertured instep portion 34, enables the booted foot to be warmed while assuring that moisture from the warmed foot will not be trapped within the upper 14, but will be vented through apertures 36 to chamber 42, thereby eliminating undesirable dampness. The heat generated within chamber 42 by warming device 32, as well as the added volume of chamber 42, will aid in the evaporation of the moisture, while also providing warmth to the booted foot. The porosity of the material of wall 44 will enable the passage of water vapor from the chamber 42 to the outside, while the presence of heat insulating layers 56 will tend to keep the warmth within the chamber 42. Further regulation of the amount of heat in the chamber 42 may be obtained by selectively positioning the slide fastener 76 so that slit 74 is open slightly to vent excess heat more rapidly.

The ease with which the warming device 32 is inserted into or removed from chamber 42 enables the wearer to insert the warming device 32 as needed and to remove the warming device for replacement or for use in other locations on the wearer's body where additional warmth is desired, even while the boot is being worn. Removal of the boot is unnecessary for selective insertion or removal of warming device 32.

The simplicity of the enclosure arrangement enables the use of the arrangement in connection with conventional existing boots. Thus, the enclosure arrangement can be furnished in kit form for the conversion of existing boots, as well as being provided as original equipment with new boots. A complete kit would include a hole punch for punching apertures 36, a source of adhesive 70, such as a tube of an adhesive, as well as the enclosure member 40 depicted in FIGS. 2 and 3. A warming device 32 could also be included in the kit.

Figure 5:
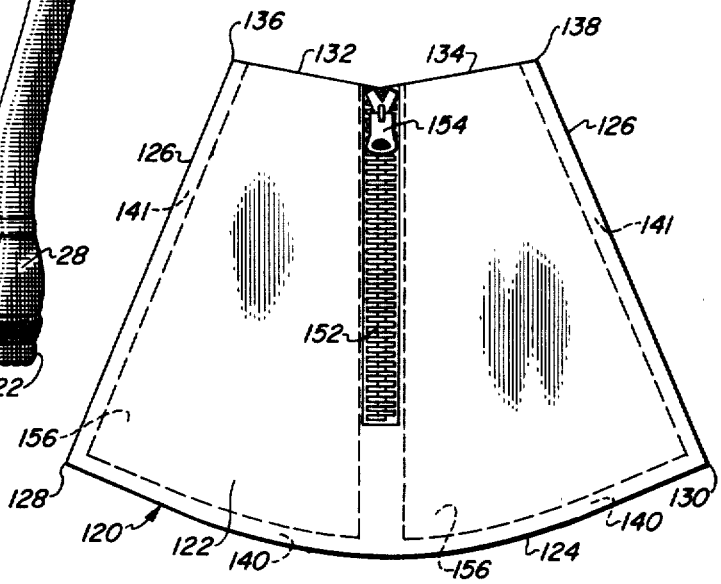
FIG. 5 is a plan view showing the outer surface of another enclosure member constructed in accordance with the invention.
Figure 6:
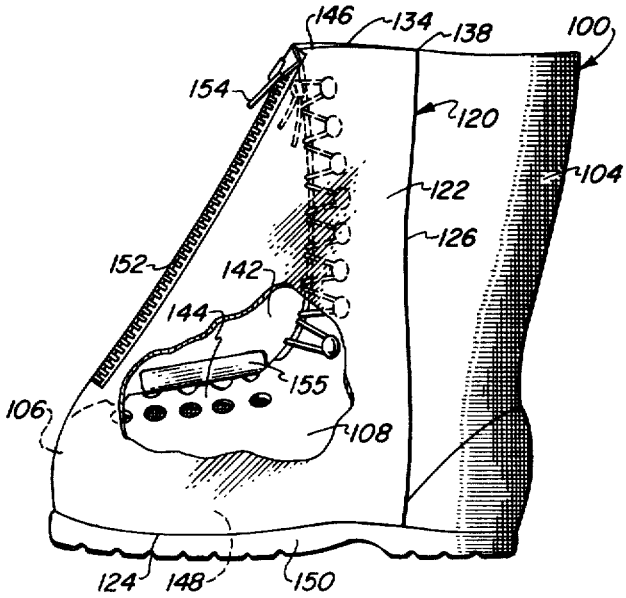
FIG. 6 is a side elevational view, partially cut away, of an enclosure arrangement employing the enclosure member of FIG. 5 in connection with another type boot.
Figure 7:
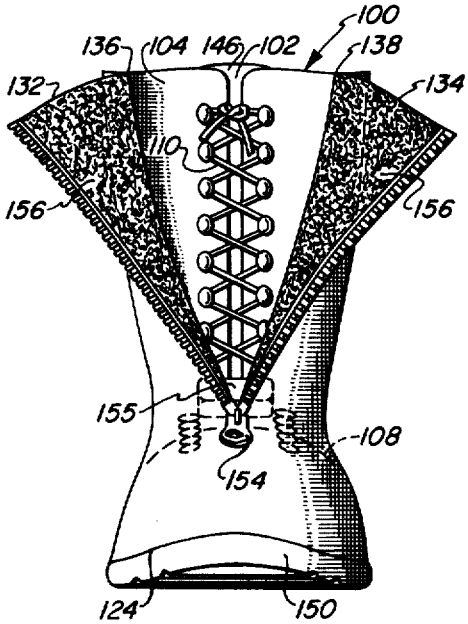
FIG. 7 is a front elevational view of the enclosure arrangement of FIG. 6, with the enclosure member open.

Referring now to FIGS. 5, 6 and 7, another embodiment of the invention is illustrated in the form of an enclosure arrangement used in connection with another style boot 100. Boot 100 is a front-laced boot having a separation 102 extending altitudinally upwardly along the sheath 104 of the boot. Separation 102 faces forward; that is, separation 102 confronts the toe 106 of the upper 108 of boot 100, and the separation 102 normally is held closed by a lace 110.

The enclosure arrangement employs an enclosure member 120 in which a wall 122 has a plan configuration including a first edge 124, second edges 126 intersecting the first edge 124 at 128 and 130, and third edges 132 and 134 opposite the first edge 124 and intersecting the second edges 126 at 136 and 138, as seen in FIG. 5. First and second edge areas 140 and 141 are provided along the respective first and second edges 124 and 126 for receiving an adhesive (not shown) so that the first and second edges can be affixed to upper 108 of boot 100, as shown in FIGS. 6 and 7.

When affixed to boot 100, enclosure member 120 establishes a chamber 142 overlying an apertured instep portion 144 of boot 100 and extending from toe 106 up to a location 146 at the top of the sheath 104 of the boot to provide a chamber of relatively large volume. First edge 124, and corresponding edge areas 140, are affixed to the upper 108 adjacent a welt area 148 and extend longitudinally generally parallel to sole 150. Second edges 126, and corresponding edge areas 141, are affixed to the upper 108 and extend altitudinally, in a generally upward vertical direction essentially perpendicular to the sole 150 of boot 100. The third edges 132 and 134 need not be so affixed since the edges are located adjacent the top of sheath 104. By not affixing the third edges 132 and 134, access to chamber 142 is eased. In addition, access to the lace 110 is facilitated by such an arrangement. Thus, an access opening in the form of a slit 152 is provided in wall 122 and a slide fastener 154 serves as a closure for the access opening.

A warming device 155 is selectively inserted into or removed from chamber 142 by opening and closing the slide fastener 154. The integrity of the boot is maintained by the enclosure member 120, while access to lace 110 and separation 102 is retained so that boot 100 will be utilized in much the same manner as it was without the enclosure arrangement.

The material of wall 122 preferably is the same as that described in the embodiment of FIGS. 1 through 4. Layers 156 of heat insulating material (see FIG. 7) may be placed upon the inner surface of wall 122, as in the earlier-described embodiment.

The embodiment of FIGS. 5 through 7 illustrates an enclosure arrangement which can be utilized in connection with a wide variety of front-opening boot styles, such as front-laced boots, zippered arctic boots, buckled boots and top-laced boots, as well as on slush or knee boots. Where a felt liner (not shown) is worn with a boot, it is advantageous to provide the liner with apertures in the area corresponding to the apertured instep portion of the boot for maximum effectiveness.

It is to be understood that the above detailed description of embodiments of the invention is provided by way of example only. Various details of design and construction may be modified without departing from the true spirit and scope of the invention as set forth in the appended claims.

The embodiments of the invention in which an exclusive property or privilege as claimed are defined as follows:

1. An enclosure arrangement for use in connection with a boot whereby a booted foot will be warmed selectively by a warming device, the boot having a longitudinally extending sole and an upper extending altitudinally from a welt area at the intersection of the sole and the upper, the sole including a toe end, a heel end and a shank between the toe end and heel end, and the upper including a toe adjacent the toe end, a counter adjacent the heel end, a sheath extending altitudinally between the toe and the counter and an apertured instep portion located between the toe and the sheath, the enclosure arrangement comprising:

an enclosure member having a wall, the wall including first edge areas for extending generally longitudinally along the welt area between the toe end of the sole and the shank, and second edge areas for extending generally altitudinally along the upper between the welt area, adjacent the shank, and a location on the sheath spaced altitudinally from the apertured instep portion a distance sufficient to establish a chamber overlying the apertured instep portion between the toe of the upper and the sheath;

means for joining the first and second edge areas with the boot so as to secure the enclosure member to the boot and establish a seal along said edges for sealing the chamber;

an access opening in the wall of the enclosure member and juxtaposed with the chamber to enable selective access to the chamber for placement therein of the warming device; and closure means for selectively opening and closing the access opening.

2. The invention of claim 1 wherein the wall is constructed of a flexible material.

3. The invention of claim 1 or 2 wherein the wall is constructed of a somewhat porous water-repellant material.

4. The invention of claim 1 including a member of heat insulating material for location between the wall and the warming device.

5. The invention of claim 4 wherein the wall has an outside surface and an inside surface, the inside surface being located for confronting the apertured instep portion, and the member of heat insulating material comprises at least one layer affixed to the inside surface of the wall.

6. The invention of claim 5 wherein the wall is constructed of a flexible material.

7. The invention of claim 5 or 6 wherein the wall is constructed of a somewhat porous water-repellant material.

8. The invention of claim 1 werein the enclosure member has a plan configuration which includes opposite edges, the first and second edge areas extend along the opposite edges, and the access opening comprises a slit located along a line extending generally transverse to the direction of extent of the first and second edges such that the slit will extend between the toe and the sheath of the upper of the boot.

9. The invention of claim 8 wherein the line is a generally straight line.

10. The invention of claim 1, 8 or 9 wherein the closure means comprises a slide fastener.

11. The invention of claim 1 wherein the means for joining the first and second edge areas with the boot comprises an adhesive means for adhering the first and second edge areas to the boot.

12. The invention of claim 11 wherein the adhesive means is located for adhering the first and second edge areas to the upper of the boot.

13. The invention of claim 11 or 12 wherein the wall is constructed of a flexible, somewhat porous water-repellant material.

14. The invention of claim 13 wherein the enclosure member has a plan configuration which includes opposite edges, the first and second edge areas extend along the opposite edges, and the access opening comprises a slit located along a line extending generally transverse to the direction of extent of the first and second edges such that the slit will extend between the toe and the sheath of the upper of the boot.

15. The invention of claim 14 wherein the closure means comprises a slide fastener.

16. The invention of claim 1 wherein the boot includes a separation extending altitudinally along the sheath and confronting the toe of the upper, and the location on the sheath is spaced from the apertured instep portion a distance sufficient to extend the chamber so that the separation will be enclosed within the chamber.

17. The invention of claim 16 wherein the means for joining the first and second edge areas with the boot comprises an adhesive means for adhering the first and second edge areas to the boot.

18. The invention of claim 17 wherein the wall is constructed of a flexible, somewhat porous water-repellant material.

19. The invention of claim 18 wherein the enclosure member has a plan configuration including a first edge, second edges intersecting the first edge, and third edges opposite the first edge and intersecting the second edges, the first edge areas extending along the first edge, the second edge areas extending along the second edges, and the access opening comprises a slit located along a line extending generally transverse to the direction of extent of the first and third edges such that the slit will extend between the toe and the sheath of the upper of the boot.

20. The invention of claim 19 wherein the closure means comprises a slide fastener.

21. The invention of claim 17, 18, 19, or 20 including a member of heat insulating material for location between the wall and the warming device.

22. The invention of claim 21 wherein the wall has an outside surface and an inside surface, the inside surface confronting the apertured instep portion, and the member of heat insulating material comprises at least one layer affixed to the inside surface of the wall.

* * * * *